US011851966B1

(12) United States Patent
He et al.

(10) Patent No.: US 11,851,966 B1
(45) Date of Patent: Dec. 26, 2023

(54) HORIZONTAL SAMPLING SOIL DRILLING RIG AND CONTROL METHOD THEREOF

(71) Applicant: Institute of Earth Environment, Chinese Academy of Sciences, Xi'an (CN)

(72) Inventors: Maoyong He, Xi'an (CN); Li Deng, Xi'an (CN); Zhangdong Jin, Xi'an (CN); Jun Xiao, Xi'an (CN); Yuanyuan Cheng, Xi'an (CN); Qing Zhou, Xi'an (CN); Jiaxin Luo, Xi'an (CN)

(73) Assignee: Institute of Earth Environment, Chinese Academy of Sciences, Xi'an (CN)

( * ) Notice: Subject to any disclaimer, the term of this patent is extended or adjusted under 35 U.S.C. 154(b) by 0 days.

(21) Appl. No.: 18/132,981

(22) Filed: Apr. 11, 2023

(30) Foreign Application Priority Data

Oct. 20, 2022 (CN) ..... 202211283686.0

(51) Int. Cl.
*E21B 25/16* (2006.01)
*E21B 7/04* (2006.01)

(52) U.S. Cl.
CPC ..... *E21B 25/16* (2013.01); *E21B 7/046* (2013.01)

(58) Field of Classification Search
CPC ..... E21B 25/16; E21B 7/046
See application file for complete search history.

(56) References Cited

U.S. PATENT DOCUMENTS 5,058,688 A * 10/1991 Scott ..... E21B 7/265 175/203
5,950,741 A 9/1999 Wright et al.
6,363,803 B1 * 4/2002 Hubers ..... E21B 49/02 73/864.43

FOREIGN PATENT DOCUMENTS

| | | | | |
|---|---|---|---|---|
| CN | 208187738 U | 12/2018 | | |
| CN | 208350414 U | 1/2019 | | |
| CN | 109849131 A | 6/2019 | | |
| CN | 214334292 U | 10/2021 | | |
| CN | 215374609 U | 12/2021 | | |
| CN | 215448544 U | 1/2022 | | |
| CN | 114798971 A | 7/2022 | | |
| JP | H10180658 A | 7/1998 | | |
| KR | 101448294 B1 * | 10/2014 | ..... | E21B 7/046 |

* cited by examiner

*Primary Examiner* — David Z Huang
(74) *Attorney, Agent, or Firm* — Bayramoglu Law Offices LLC

(57) ABSTRACT

A horizontal sampling soil drilling rig and a control method are used to solve the problem that the soil sampling device in the prior art has difficulty in horizontal sampling. The horizontal sampling soil drilling rig includes a rack, a connection assembly, a drive mechanism, a spiral drill rod, and a sampler. The rack is provided with a spline shaft and a screw rod in parallel. The screw rod and the spline shaft are connected through a first transmission assembly in transmission connection. The drive mechanism includes a rotation driver, a second transmission assembly, and a spline shaft sleeve. The spline shaft sleeve is rotationally connected to the rack, and the spline shaft sleeve and the spline shaft mesh with each other. The rotation driver is connected with the spline shaft through the second transmission assembly in transmission connection.

9 Claims, 5 Drawing Sheets

HORIZONTAL SAMPLING SOIL DRILLING RIG AND CONTROL METHOD THEREOF

CROSS REFERENCE TO THE RELATED APPLICATIONS

This application is based upon and claims priority to Chinese Patent Application No. 202211283686.0, filed on Oct. 20, 2022, the entire contents of which are incorporated herein by reference.

TECHNICAL FIELD

The present disclosure relates to the technical field of soil sampling equipment, in particular to a horizontal sampling soil drilling rig and a control method thereof.

BACKGROUND

The loess region in China has complex landforms and deep gullies. Loess is a special soil with characteristics such as collapsibility, macropores, and low mechanical strength after immersion in water, so that loess slope destruction often occurs. Common loess slope engineering problems include collapsible deformation, landslides, collapses, mud flows, and slope erosion, all of which ultimately belong to stability issues. Therefore, the degree of chemical weathering of loess is studied by conducting soil sampling on the loess slope and performing element content and isotope analysis on soil samples, so as to deeply understand the structural composition and stability mechanism of loess, providing scientific basis for preventing loess slope collapse and landslide.

However, most existing soil sampling equipment can only conduct vertical sampling. When it needs to study soil changes in the horizontal direction, vertical soil sampling equipment is not suitable. Because horizontal sampling is more prone to collapse, sampling is more difficult. Although hand-held manual sampling equipment on the current market can also conduct horizontal sampling, it is only suitable for surface soil sampling, and is relatively laborious and inefficient.

SUMMARY

In view of the defects of the prior art described above, the object of the present disclosure is to provide a horizontal sampling soil drilling rig and a control method thereof for solving the problem that the soil sampling device in the prior art has difficulty in horizontal sampling and can only conduct surface soil sampling.

In order to realize the above object and other relevant purposes, a horizontal sampling soil drilling rig provided by the present disclosure includes a rack, a connection assembly, a drive mechanism, a spiral drill rod, and a sampler. The rack is provided with a spline shaft and a screw rod in parallel, wherein the screw rod and the rack are threaded connected, and the screw rod and the spline shaft are connected through a first transmission assembly in transmission connection; the connection assembly includes a first connection plate and a second connection plate, the first connection plate and the second connection plate are respectively arranged at both ends of the screw rod, the screw rod and the spline shaft are rotationally connected to the first connection plate, and the screw rod and the spline shaft are rotationally connected to the second connection plate.

The drive mechanism includes a rotation driver, a second transmission assembly, and a spline shaft sleeve. The rotation driver is fixedly connected to the rack, the spline shaft sleeve is rotationally connected to the rack, the spline shaft sleeve and the spline shaft mesh with each other, and the rotation driver is connected with the spline shaft sleeve through the second transmission assembly in transmission connection.

One end of the spiral drill rod is fixedly connected with the screw rod through a first joint, the other end of the spiral drill rod is provided with an open-close drill bit, and the spiral drill rod is of a hollow structure. The sampler is arranged inside the spiral drill rod, and the sampler is fixedly connected to the screw rod or to the first connection plate through a second joint.

Optionally, the first transmission assembly includes a first gear and a second gear, the first gear and the spline shaft are fixedly connected coaxially, the second gear and the screw rod are fixedly connected coaxially, and the first gear and the second gear mesh with each other.

Optionally, the second transmission assembly includes a third gear and a fourth gear, the third gear and an output shaft of the rotation driver are fixedly connected coaxially, the fourth gear and the spline shaft sleeve are fixedly connected coaxially, and the third gear and the fourth gear mesh with each other.

Optionally, the open-close drill bit includes a plurality of open-close components, wherein the plurality of open-close components are combined into a cone along a center line of the open-close drill bit; each of the plurality of open-close components is provided with a spiral blade; each of the plurality of open-close components is hinged with the spiral drill rod; and a hinge joint of the spiral drill rod and each of the plurality of open-close components is provided with a torsion spring.

Optionally, the horizontal sampling soil drilling rig further includes a support assembly. The support assembly includes a plurality of support legs. Each of the plurality of support legs includes a telescopic rod and a fixed base, the fixed base is fixedly connected to ground, one end of the telescopic rod is fixedly connected to the fixed base, and the other end of the telescopic rod is fixedly connected to the rack.

Optionally, both the first joint and the second joint include a threaded section and a quick release section, wherein the quick release section is provided with a connection hole, an end of the screw rod is provided with a protruding section, and the connection hole match with the protruding section. The threaded section of the first joint is threaded to the spiral drill rod, and the threaded section of the second joint is threaded to the sampler.

Optionally, the spiral drill rod includes a plurality of screw sections, the plurality of screw sections are fixedly spliced along an axial direction, and spiral vanes are arranged on the plurality of screw sections.

Optionally, a fixed connector is fixedly arranged on the first connection plate, and the shape and the size of the fixed connector match with that of the connection hole.

Optionally, the sampler includes a sampling section and a plurality of connection sections. The sampling section is a cylindrical structure with an opening at one end, the sampling section and the plurality of connection sections are fixedly connected, the plurality of connection sections are fixedly spliced along an axial direction, and an annular cutter is provided at the opening of the sampling section.

A control method of the horizontal sampling soil drilling rig includes the following steps:

Surface soil rotary sampling step: fixedly connecting the sampler with the screw rod through the second joint; then activating the rotation driver, so as to drive the screw rod to rotate by the rotation driver, the sampler is driven to rotate and drill into soil by the screw rod, the soil is cut under a rotation of the sampler, and the soil enters the sampler along an opening of the sampler; and then controlling the screw rod to rotate in reverse direction through the rotation driver, so that the screw rod drives the sampler to separate from the soil to complete soil sampling;

Surface soil push-in sampling step: fixedly connecting the sampler with the first connection plate through the second joint; then activating the rotation driver, so as to drive the screw rod to rotate by the rotation driver, and the screw rod pushes the first connection plate to make a linear motion; the sampler is forcibly pushed into the soil by the first connection plate, and the soil enters the sampler along the opening of the sampler; and then controlling the screw rod to rotate in reverse direction through the rotation driver, so that the screw rod drives the first connection plate and the sampler to separate from the soil to complete soil sampling;

Deep soil sampling step: connecting the spiral drill rod with the screw rod through the first joint; then activating the rotation driver, the spiral drill rod is driven to move by the screw rod; removing the first joint after the spiral drill rod is drilled into the soil to reach a sampling depth, and controlling the screw rod to rotate in reverse direction through the rotation driver, so that the screw rod moves in reverse direction of drilling and the screw rod and the spiral drill rod are far away from each other, at this time, the sampler is inserted into the spiral drill rod, and the sampler is fixedly connected to the screw rod through the second joint; the screw rod drives the sampler to move along a drilling direction, the sampler pushes open the open-close drill bit, the sampler passes through the open-close drill bit for sampling, the screw rod rotates in reverse direction after sampling is completed, the screw rod drives the sampler to move in reverse direction until the soil sample is taken out, and then the screw rod is connected to the spiral drill rod again; at this time, the open-close drill bit automatically closes after the sampler is disengaged, and the spiral drill rod continues to drill until it reaches a next sampling point.

As described above, the horizontal sampling soil drilling rig and the control method of the present disclosure have at least the following advantageous effects:

1. The rotation driver drives the spline shaft sleeve to rotate through the second transmission assembly, the spline shaft is driven to rotate by the spline shaft sleeve, and the spline shaft drives the screw rod to rotate through the first transmission assembly. Due to the thread fitting between the screw rod and the rack, and the rack is fixed, the screw rod simultaneously moves along the axis direction during the rotation process. At this time, there are at least three soil sampling modes: 1. The sampler is fixedly connected with the screw rod through the second joint, and the screw rod drives the sampler to rotate for drilling and sampling. 2. The sampler is fixedly connected with the first connection plate through the second joint, the screw rod pushes the first connection plate for linear motion, and the first connection plate pushes the sampler for push-in sampling. 3. The spiral drill rod is fixedly connected to the screw rod through the first joint, and the screw rod drives the spiral drill rod to move; after the spiral drill rod is drilled into the soil and reach to the sampling depth, the screw rod rotates in reverse direction, and the screw rod moves in the reverse direction of drilling, then the screw rod and the spiral drill rod are separated, and at this time, the sampler is inserted into the spiral drill rod, the sampler is fixedly connected with the screw rod through the second joint, the sampler drives the sampler to move along the drilling direction, the sampler pushes the open-close drill bit open, the sampler passes through the open-close drill bit to sample; after sampling is completed, the screw rod rotates in reverse direction, the screw rod drives the sampler to move in reverse direction; after taking out soil samples, the screw rod is connected to the spiral drill rod again, at this time, the open-close drill bit automatically closes after the sampler is disengaged, and the spiral drill rod continues to drill until it reaches the next sampling point.
2. Due to the twist spring provided at the hinge of the spiral drill rod and the open-close component, when the sampler leaves the open-close drill bit, the open-close component is closed to the center line of the open-close drill bit under the action of the twist spring.
3. Since the spiral drill rod is fixedly spliced by several screw sections along the axial direction, the drilling depth of the spiral drill rod can be increased by increasing the number of screw sections.

Figure 1:
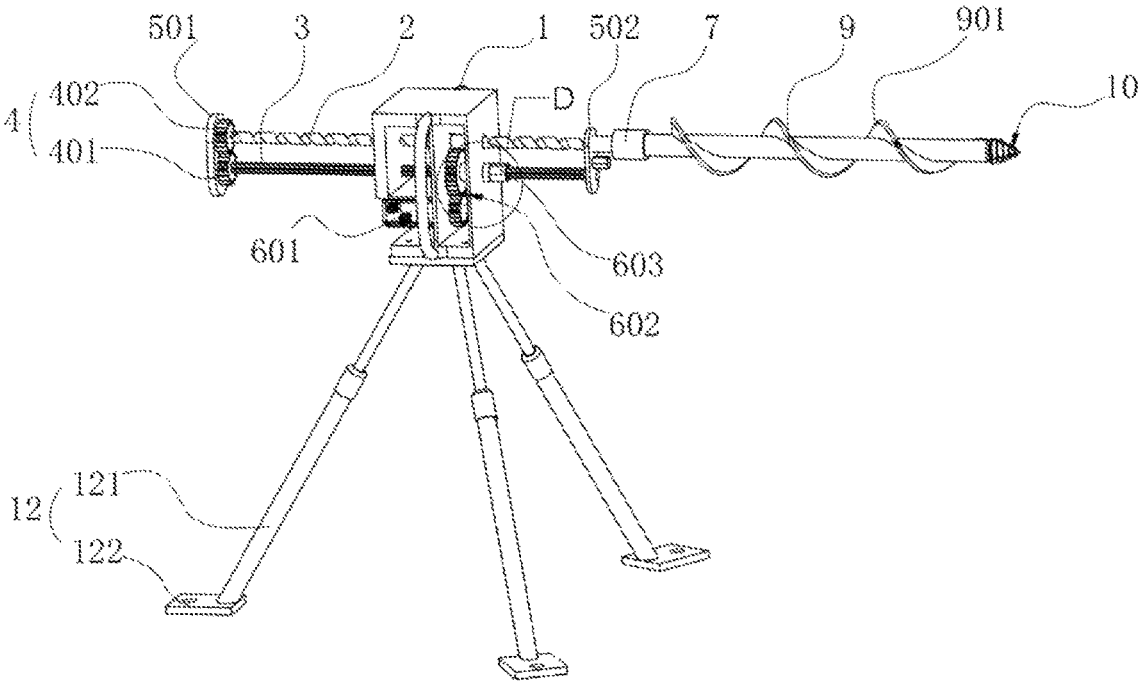
FIG. 1 is a three-dimensional structure diagram of a horizontal sampling soil drilling rig in the present disclosure.

The description of the reference marks in the drawings are as following:

1. rack;
2. screw rod; 201. protruding section;
3. spline shaft;
4. the first transmission assembly; 401. the first gear; 402. the second gear;
501. the first connection plate; 502. the second connection plate; 5011. gear cover; 5021. fixed connector;

601. rotation driver; 602. the second transmission assembly; 603. spline shaft sleeve; 6021. the third gear; 6022. the fourth gear;

7. the first joint;

8. the second joint;

9. spiral drill rod; 901. spiral vane; 902. guide cylinder; open-close drill bit; 101. open-close component; 1011. spiral blade;

11. sampler; 111. sampling section; 112. connection section;

12. support leg; 121. telescopic rod; 122. fixed base;

13. pin;

14. handle.

DETAILED DESCRIPTION OF THE EMBODIMENTS

The following specific embodiments illustrate the implementation of the disclosure. Those skilled person in the art can easily understand the other advantages and effect of the disclosure from the content disclosed in this specification.

Please refer to FIGS. 1 to 10 to understand that the structures, proportions, sizes and etc. depicted in the accompanying drawings of this specification are only used to match the content disclosed in the specification for those skilled in the art to understand and read, and are not intended to limit the implementable conditions of the disclosure, thus, it has no technical significance. Without affecting the effect and purpose of the disclosure, any modifications to the structure, changes in the scale relationship, or adjustments in size should still be fallen within the scope of the technical content disclosed in the disclosure. At the same time, the terms "up", "down", "left", "right", "middle", and "one" cited in this specification are only for the sake of clarity, rather than limiting the scope of implementation of the disclosure. Changes or adjustments to their relative relationships should also be considered as the scope of the disclosure without substantial changing the technical content.

The following embodiments are for illustrative purposes only. Various embodiments can be combined with each other, which are not limited to the content shown in the following single embodiment.

Figure 2:
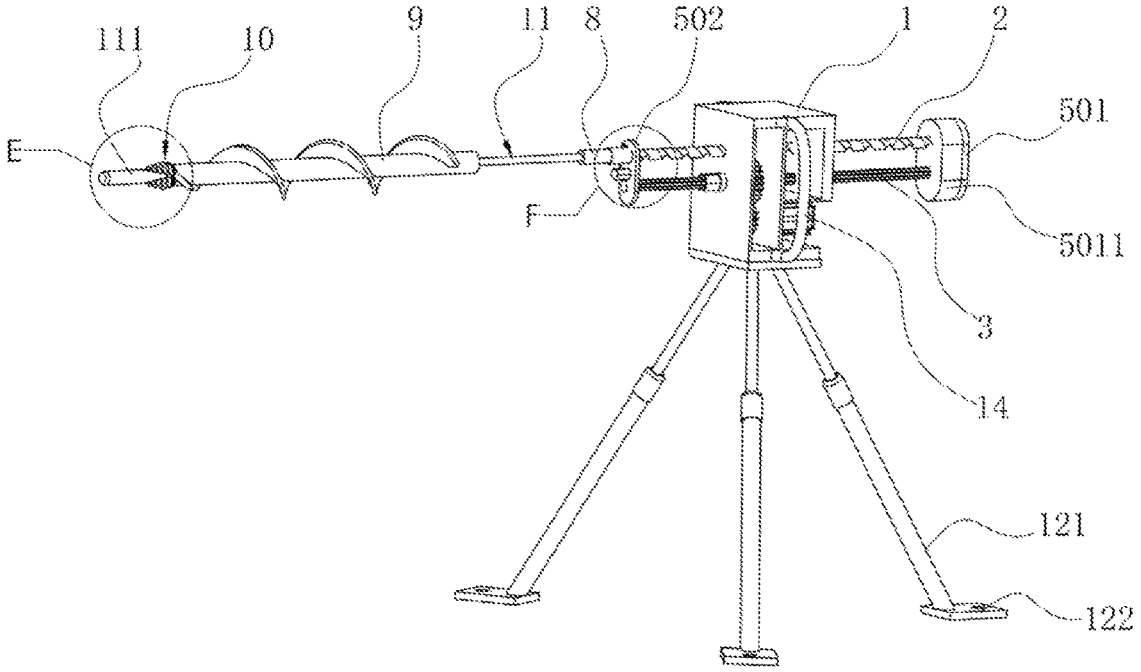
FIG. 2 is a three-dimensional structure diagram of the deep soil sampling state of the horizontal soil sampling drill in the present disclosure.
Figure 3:
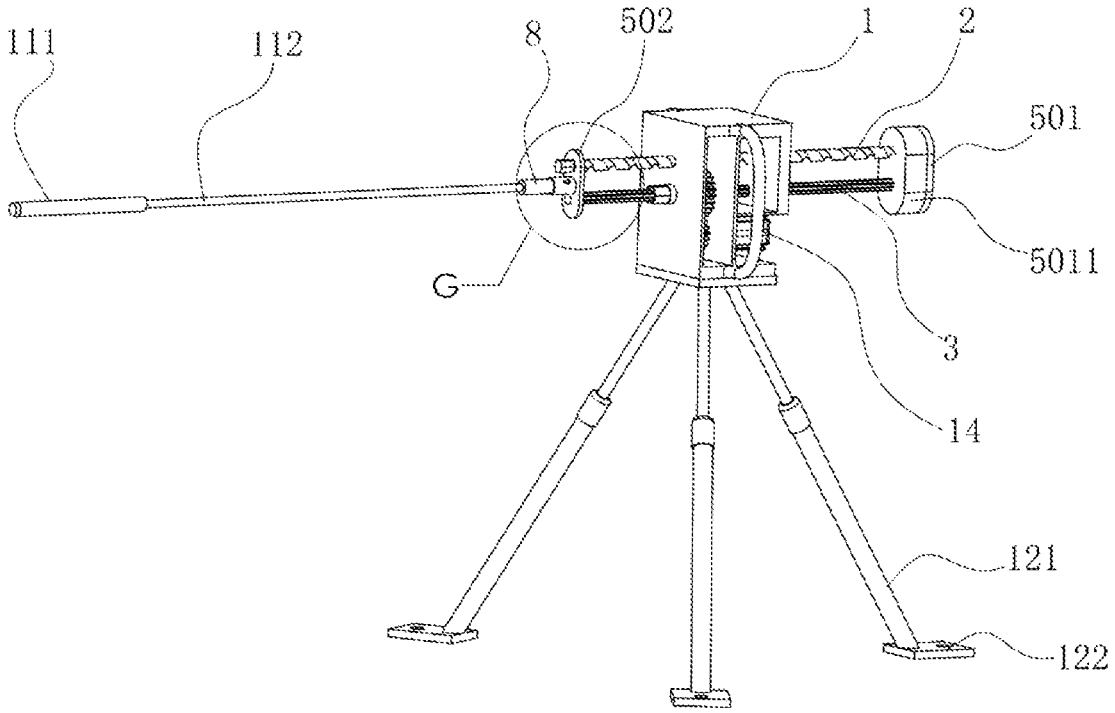
FIG. 3 is a three-dimensional structure diagram of the push-type sampling state of a horizontal soil sampling drill according to the present disclosure.
Figure 4:
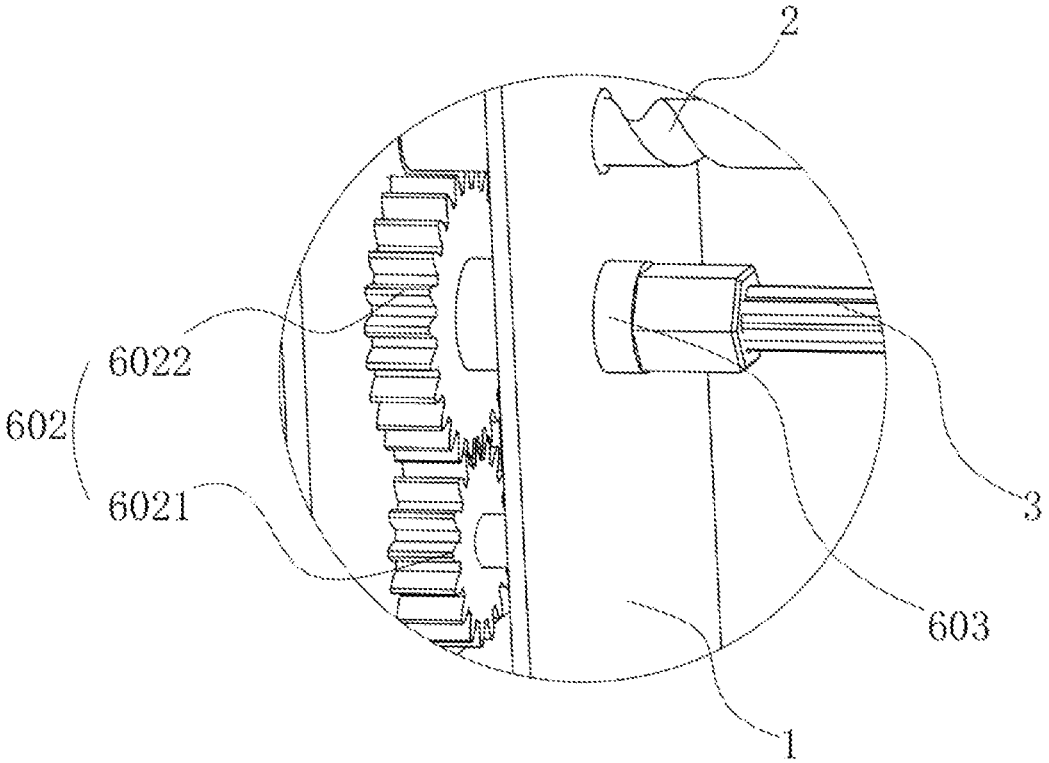
FIG. 4 is an enlarged partial view of part D in FIG. 1 of the present disclosure.

Referring to FIGS. 1 to 3, the present disclosure provides a horizontal sampling soil drilling rig, which includes a rack 1, a connection assembly, a drive mechanism, a spiral drill rod 9, and a sampler 11. The rack 1 is provided with a spline shaft 3 and a screw rod 2 in parallel, wherein the screw rod 2 and the rack 1 are threaded, the screw rod nut can be fixedly installed on the rack 1, and the screw rod 2 and the screw rod nut are matched. The screw rod 2 passes through the screw rod nut, and the screw rod 2 and the spline shaft 3 are connected through a first transmission assembly 4, wherein the first transmission assembly may be a gear set, a sprocket set, or a pulley assembly. The connection assembly includes a first connection plate 501 and a second connection plate 502. The first connection plate 501 and the second connection plate 502 are respectively arranged at both ends of the screw rod 2, the screw rod 2 and the spline shaft 3 are rotationally connected to the first connection plate 501, and the screw rod 2 and the spline shaft 3 are rotationally connected to the second connection plate 502. Wherein the screw rod 2, the first connection plate 501, and the second connection plate 502 can be rotationally connected through bearings, and the spline shaft 3, the first connection plate 501, and the second connection plate 502 can be rotationally connected through bearings.

The drive mechanism includes a rotation driver 601, a second transmission assembly 602, and a spline shaft sleeve 603. The rotation driver 601 is fixedly connected to the rack 1, and can be connected by bolts. The rotation driver 601 may be a motor, pneumatic motor, or hydraulic motor, or a gasoline or diesel engine. The spline shaft sleeve 603 can be rotationally connected to the rack 1 through bearings. The spline shaft sleeve 603 and the spline shaft 3 mesh with each other, and the spline shaft 3 can freely slide in the spline shaft sleeve 603. The rotation driver 601 is connected with the spline shaft sleeve 603 through the second transmission assembly 602, and the second transmission assembly 602 may be a gear set, a sprocket set, or a pulley assembly.

One end of the spiral drill rod 9 is fixedly connected with the screw rod 2 through a first joint 7, and the other end of the spiral drill rod 9 is provided with an open-close drill bit 10. The spiral drill rod 9 is a hollow structure, and the sampler 11 is arranged inside the spiral drill rod 9. The sampler 11 can be fixedly connected with the screw rod 2 through a second joint 8, and the sampler 11 can be fixedly connected with the first connection plate 501 through a second joint 8.

The rotation driver 601 drives the spline shaft sleeve 603 to rotate through the second transmission assembly 602, the spline shaft 3 is driven to rotate by the spline shaft sleeve 603, and the spline shaft 33 drives the screw rod 2 to rotate through the first transmission assembly 4. Due to the thread fitting between the screw rod 2 and the rack 1 and the rack 1 is fixed, the screw rod 2 simultaneously moves along the axis direction during the rotation process. At this time, there are at least three soil sampling modes: 1. The sampler 11 is fixedly connected with the screw rod 2 through the second joint 8, and the screw rod 2 drives the sampler 11 to rotate for drilling and sampling. 2. The sampler 11 is fixedly connected with the first connection plate 501 through the second joint 8, the screw rod 2 pushes the first connection plate 501 for linear motion, and the first connection plate 501 pushes the sampler 11 for push-in sampling. 3. The spiral drill rod 9 is fixedly connected to the screw rod 2 through the first joint 7, and the screw rod 2 drives the spiral drill rod 9 to move; after the spiral drill rod 9 is drilled into the soil and reach to the sampling depth, the screw rod 2 rotates in reverse direction, and the screw rod 2 moves in the reverse direction of drilling, then the screw rod 2 and the spiral drill rod 9 are separated, and at this time, the sampler 11 is inserted into the spiral drill rod 9, the sampler 11 is fixedly connected with the screw rod 2 through the second joint 8, the sampler 11 drives the sampler 11 to move along the drilling direction, the sampler 11 pushes the open-close drill bit 10 open, the sampler 11 passes through the open-close drill bit 10 to sample; after sampling is completed, the screw rod 2 rotates in reverse direction, the screw rod 2 drives the sampler 11 to move in reverse direction; after taking out soil samples, the screw rod 2 is connected to the spiral drill rod 9 again, at this time, the open-close drill bit 10 automatically closes after the sampler 11 is disengaged, and the spiral drill rod 9 continues to drill until it reaches the next sampling point.

In this embodiment, please refer to FIGS. 1-9, the first transmission assembly 4 includes a first gear 401 and a second gear 402. The first gear 401 and the spline shaft 3 are fixedly connected coaxially, the second gear 402 and the screw rod 2 are fixedly connected coaxially, and the first gear 401 and the second gear 402 mesh with each other. The spline shaft 3 drives the first gear 401 to rotate, the first gear 401 drives the second gear 402 to rotate, and the second gear 402 drives the screw rod 2 to rotate. A gear cover 5011 can be arranged outside the first gear 401 and the second gear 402 to prevent dust from entering.

In this embodiment, please refer to FIGS. 1 to 4, the second transmission assembly 602 includes a third gear 6021 and a fourth gear 6022. The output shaft of the third gear 6021 and the rotation driver 601 are fixedly connected coaxially, the fourth gear 6022 and the spline shaft sleeve 603 are fixedly connected coaxially, and the third gear 6021 and the fourth gear 6022 mesh with each other. The rotation driver 601 drives the third gear 6021 to rotate, the third gear 6021 drives the fourth gear 6022 to rotate, the fourth gear 6022 drives the spline shaft sleeve 603 to rotate, and the spline shaft sleeve 603 drives the spline shaft 3 to rotate.

Figure 5:
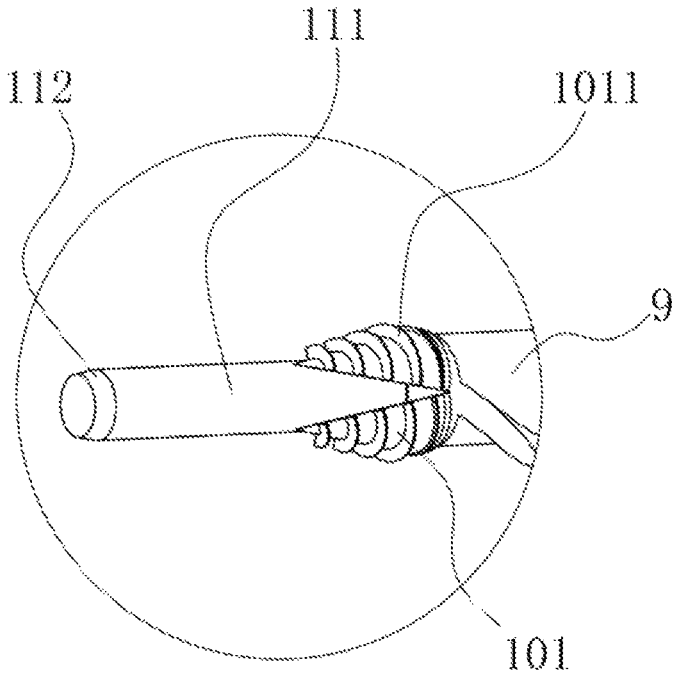
FIG. 5 is an enlarged partial view of part E in FIG. 2 of the present disclosure.
Figure 6:
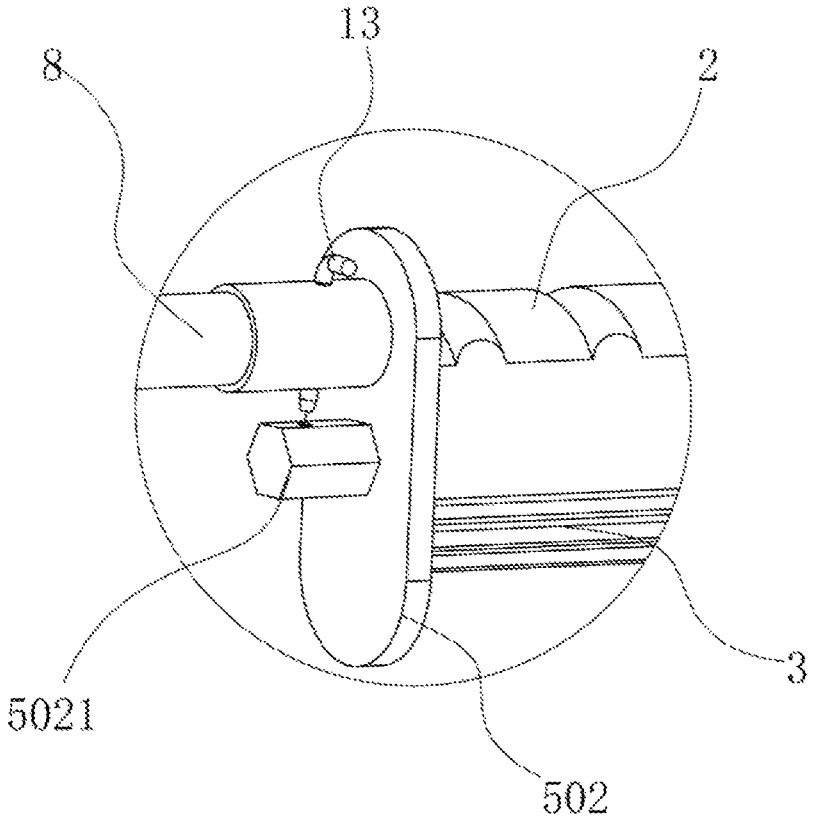
FIG. 6 is an enlarged partial view of part F in FIG. 2 of the present disclosure.
Figure 8:
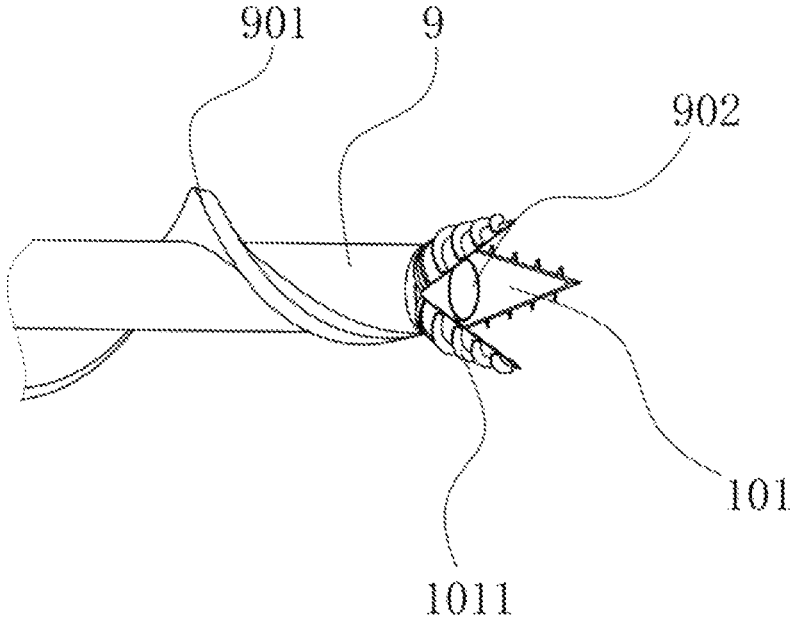
FIG. 8 is a three-dimensional structure diagram shown that the open-close drill bit of the present disclosure is in the open state.
Figure 9:
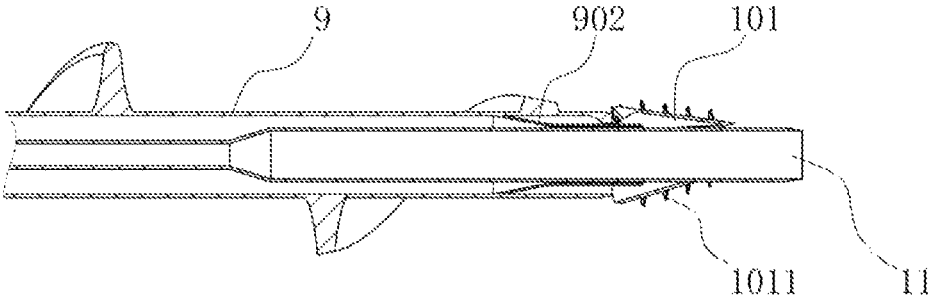
FIG. 9 is a cross-sectional view of the open-close drill bit in the present disclosure.
Figure 10:
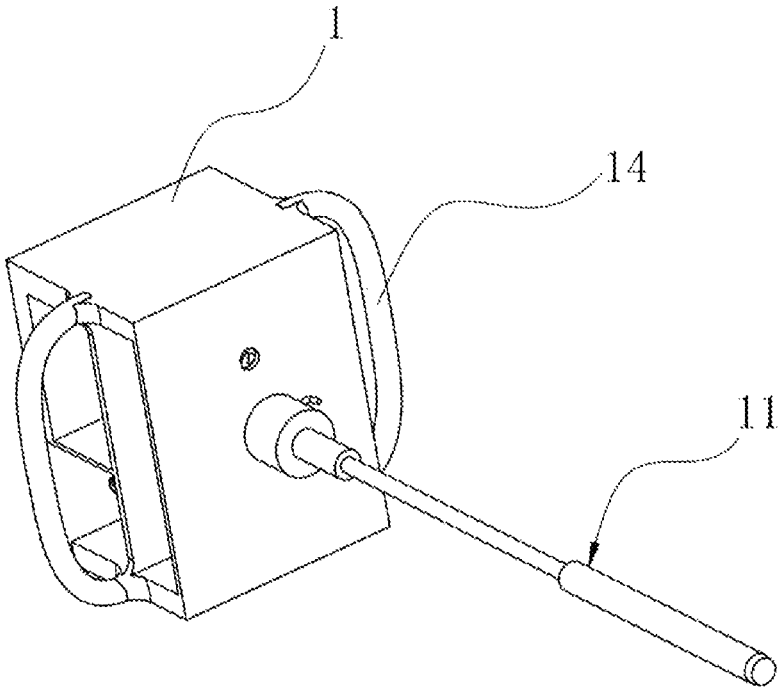
FIG. 10 is a three-dimensional structure diagram of the handheld mode of the horizontal sampling soil drilling rig in the present disclosure.

In this embodiment, please refer to FIGS. 5, 8, and 9, the open-close drill bit 10 includes a plurality of open-close components 101 that are assembled into a cone along the center line of the open-close drill bit 10. The open-close component 101 is provided with a spiral blade 1011, the open-close component 101 is hinged with the spiral drill rod 9, and the hinge joint of the spiral drill rod 9 and the open-close component 101 is provided with a torsion spring. The open-close component 101 is controlled by the torsion spring to converge towards the center of the open-close drill bit 10. A guide cylinder 902 is arranged inside the spiral drill rod 9 at the connection of the open-close component 101, and the guide cylinder 902 guides the sampler 11 to prevent the sampler 11 from touching the hinge part when reaching into the drill bit.

In this embodiment, please refer to FIGS. 1 to 3, the horizontal sampling soil drilling rig also includes a support assembly. The support assembly includes a plurality of support legs 12, and the support legs 12 are fixedly connected to the rack 1. Each of the support legs 12 includes a telescopic rod 121 and a fixed base 122, the fixed base 122 is fixedly connected to the ground, and a through hole is provided on the fixed base 122. A long screw or an anchor rod can be threaded through the through hole to fix the fixed base 122 to the ground. One end of the telescopic rod 121 is fixedly connected to the fixed base 122, and the other end of the telescopic rod 121 is fixedly connected to the rack 1. The height of the rack 1 can be regulated through the telescopic rod 121.

Figure 7:
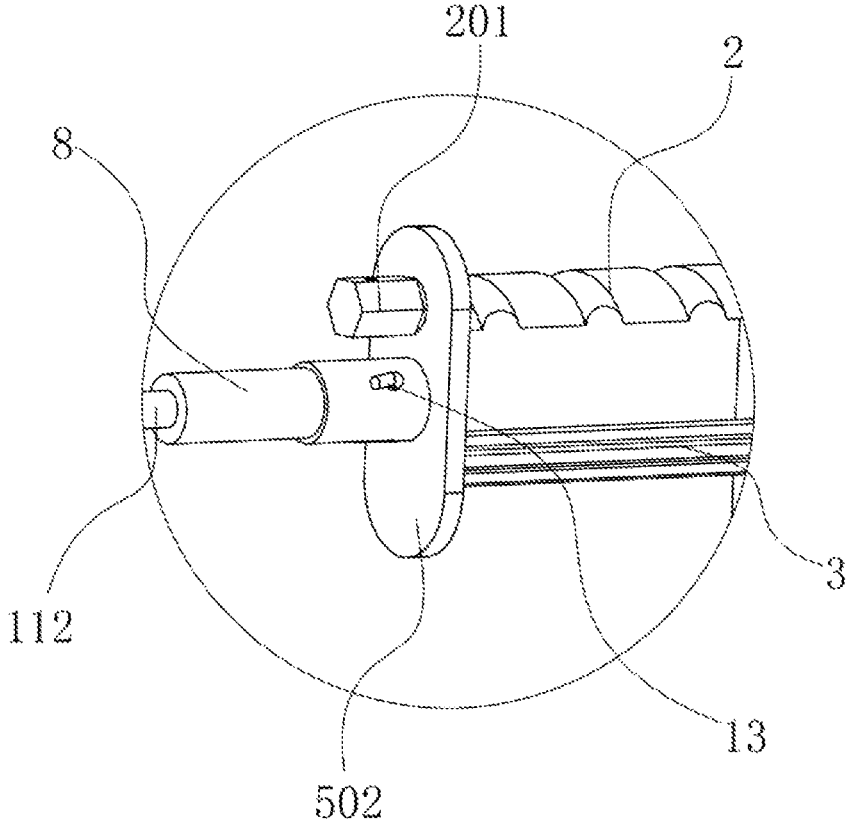
FIG. 7 is an enlarged partial view of the part G in FIG. 3 of the present disclosure.

In this embodiment, please refer to FIGS. 1, 2, and 7. One end of the first joint 7 is fixedly connected to the screw rod 2, the first joint 7 can be sleeved on the end of the screw rod 2 and fixedly connected through a bolt or pin 13, and the other end of the first joint 7 is fixedly connected to the spiral drill rod 9 and fixedly connected through a bolt or pin 13. One end of the second joint 8 can be fixedly connected to the screw rod 2, the second joint 8 can be sleeved on the end of the screw rod 2 and fixedly connected by a bolt or pin 13 to facilitate disassembly, and the other end of the second joint 8 can be fixedly connected to the spiral drill rod 9 and can be fixed by a bolt or pin 13.

In this embodiment, please refer to FIGS. 1, 2, and 7, both the first joint 7 and the second joint 8 include a quick release section and a threaded section. The quick release section is provided with a connection hole, and the end of the screw rod 2 is provided with a protruding section 201. The shape and the size of the protruding section 201 match with that of the connection hole. The protruding section 201 is inserted into the connection hole and fixed with a bolt or pin 13. The threaded section of the first joint 7 is threaded to the spiral drill rod 9, and the threaded section of the second joint 8 is threaded to the sampler 11, with a simple structure and convenient connection.

In this embodiment, please refer to FIGS. 1 to 3, the spiral drill rod 9 includes a plurality of screw sections that are fixedly spliced along the axial direction. The adjacent screw sections can be tenoned together and then fixed with bolts. The screw sections are provided with spiral vanes 901, which can increase the number of screw sections based on the actual sampling depth to achieve the purpose of increasing the drilling depth.

In this embodiment, please refer to FIGS. 2-6, the first connection plate 501 is fixedly installed with a fixed connector 5021 which cooperates with the connection hole. The sampler 11 can be connected with the fixed connector 5021 through the second joint 8, and the second joint 8 is sleeved on the fixed connector 5021 and fixed by a bolt or pin 13.

In this embodiment, please refer to FIGS. 1 to 3, the sampler 11 includes a sampling section 111 and a plurality of connection sections 112. The sampling section 111 and the connection sections 112 are fixedly connected, which can be welded or bolted. The plurality of connection sections 112 are fixedly spliced along the axial direction. The adjacent connection sections 112 can be tenoned together and then fixed with bolts, and the number of connection sections 112 can be increased according to the depth of sampling. The sampling section 111 is a cylindrical structure with an opening at one end. The opening of the sampling section 111 is provided with an annular cutter or cutting teeth. When conducting rotary sampling, a sampler 11 containing cutting teeth is used, and when conducting push-in sampling, a sampler 11 containing an annular cutter is used.

In this embodiment, please refer to FIGS. 1, 2, 4, and 10. The rack 1 is provided with a handle 14, the screw rod 2 and the spline shaft 3 are removed, and the sampler 11 and the spline shaft sleeve 603 are directly and fixedly connected. The rotation driver 601 drives the third gear 6021 to rotate, the third gear 6021 drives the fourth gear 6022 to rotate, and the fourth gear 6022 drives the spline shaft 3 to rotate, and the spline shaft 3 drives the sampler 11 to rotate for sampling. Handheld sampling can be performed in places where it is not convenient to set up sampling equipment.

A control method of the horizontal sampling soil drilling rig includes the following steps:

Surface soil rotary sampling step: fixedly connecting the sampler 11 with the screw rod 12 through the second joint 8; then activating the rotation driver 601, so as to drive the screw rod 2 to rotate by the rotation driver 601, the sampler 11 is driven to rotate and drill into soil by the screw rod 2, the soil is cut under a rotation of the sampler 11, and the soil enters the sampler 11 along an opening of the sampler 11; and then controlling the screw rod 2 to rotate in reverse direction through the rotation driver 601, so that the screw rod 2 drives the sampler 11 to separate from the soil to complete soil sampling.

Surface soil push-in sampling step: fixedly connecting the sampler 11 with the first connection plate 501 through the second joint 8; then activating the rotation driver 601, so as to drive the screw rod 2 to rotate by the rotation driver 601, and the screw rod 2 pushes the first connection plate 501 to make a linear motion; the sampler 11 is forcibly pushed into the soil by the first connection plate 501, and the soil enters the sampler 11 along the opening of the sampler 11; and then controlling the screw rod 2 to rotate in reverse direction through the rotation driver 601, so that the screw rod 2 drives the first connection plate 601 and the sampler 11 to separate from the soil to complete soil sampling.

Deep soil sampling step: connecting the spiral drill rod 9 with the screw rod 2 through a first joint 7; then activating the rotation driver 601, the spiral drill rod 9 is driven to move by the screw rod 2; removing the first joint 7 after the spiral drill rod 9 is drilled into the soil to reach a sampling depth, and controlling the screw rod 2 to rotate in reverse direction through the rotation driver 601, so that the screw rod 2 moves in reverse direction of drilling and the screw rod 2 and the spiral drill rod 9 are far away from each other, at this time, the sampler 11 is inserted into the spiral drill rod 9, and the sampler 11 is fixedly connected to the screw rod 2 through the second joint 8; the screw rod 2 drives the sampler 11 to move along a drilling direction, the sampler 11 pushes open the open-close drill bit 10, so that the sampler 11 passes through the open-close drill bit 10 for sampling; the screw rod 2 rotates in reverse direction after sampling is completed, the screw rod 2 drives the sampler 11 to move in reverse direction until the soil sample is taken out, and then the screw rod 2 is connected to the spiral drill rod 9 again; at this time, the open-close drill bit 10 automatically closes after the sampler 11 is disengaged, and the spiral drill rod 9 continues to drill until it reaches a next sampling point.

In summary, the rotation driver 601 drives the spline shaft sleeve 603 to rotate through the second transmission assembly 602, and the spline shaft sleeve 603 drives the spline shaft 3 to rotate. The spline shaft 3 drives the screw rod 2 to rotate through the first transmission assembly 4. Since the screw rod 2 and the rack 1 are threaded together and the rack 1 are fixed, the screw rod 2 simultaneously moves along the axis direction during the rotation process, so that the screw rod 2 can drive the spiral drill rod 9 to drill holes, and can also drive the sampler 11 to take samples, which can also achieve rotary or push-type sampling, surface soil sampling, and deep formation sampling. Besides, it can be set up for automatic sampling, or hand-held sampling. Therefore, the present disclosure effectively overcomes various defects in the prior art and has high industrial utilization value.

The above embodiments only illustrate the principle and effect of the disclosure, and are not intended to limit the disclosure. Any skilled person in the art may modify or change the above embodiments without departing the spirit and scope of the disclosure. Therefore, all equivalent modifications or changes made by those with ordinary skilled person in the art without departing from the spirit and technical ideas disclosed in the disclosure should still be fallen into the claims of the disclosure.

What is claimed is:

1. A horizontal sampling soil drilling rig, comprising a rack, wherein the rack is provided with a spline shaft and a screw rod in parallel, the screw rod and the rack are threaded connected, and the screw rod and the spline shaft are connected through a first transmission assembly in transmission connection;

a connection assembly, wherein the connection assembly comprises a first connection plate and a second connection plate, the first connection plate and the second connection plate are respectively arranged at both ends of the screw rod, the screw rod and the spline shaft are rotationally connected to the first connection plate, and the screw rod and the spline shaft are rotationally connected to the second connection plate;

a drive mechanism, wherein the drive mechanism comprises a rotation driver, a second transmission assembly, and a spline shaft sleeve; the rotation driver is fixedly connected to the rack, the spline shaft sleeve is rotationally connected to the rack, the spline shaft sleeve and the spline shaft mesh with each other, and the rotation driver is connected with the spline shaft sleeve through the second transmission assembly in transmission connection;

a spiral drill rod, wherein one end of the spiral drill rod is fixedly connected with the screw rod through a first joint, the other end of the spiral drill rod is provided with an open-close drill bit, and the spiral drill rod is of a hollow structure; and a sampler, wherein the sampler is fixedly connected to the screw rod or to the first connection plate through a second joint.

2. The horizontal sampling soil drilling rig according to claim 1, wherein the first transmission assembly comprises a first gear and a second gear, the first gear and the spline shaft are fixedly connected coaxially, the second gear and the screw rod are fixedly connected coaxially, and the first gear and the second gear mesh with each other.

3. The horizontal sampling soil drilling rig according to claim 1, wherein the second transmission assembly comprises a third gear and a fourth gear, the third gear and an output shaft of the rotation driver are fixedly connected coaxially, the fourth gear and the spline shaft sleeve are fixedly connected coaxially, and the third gear and the fourth gear mesh with each other.

4. The horizontal sampling soil drilling rig according to claim 1, wherein the open-close drill bit comprises a plurality of open-close components, wherein the plurality of open-close components are combined into a cone along a center line of the open-close drill bit; each of the plurality of open-close components is provided with a spiral blade; each of the plurality of open-close components is hinged with the spiral drill rod; and a hinge joint of the spiral drill rod and each of the plurality of open-close components is provided with a torsion spring.

5. The horizontal sampling soil drilling rig according to claim 4, wherein the horizontal sampling soil drilling rig further comprises a support assembly; the support assembly comprises a plurality of support legs; each of the plurality of support legs comprises a telescopic rod and a fixed base, the fixed base is fixedly connected to ground, one end of the telescopic rod is fixedly connected to the fixed base, and the other end of the telescopic rod is fixedly connected to the rack.

6. The horizontal sampling soil drilling rig according to claim 4, wherein both the first joint and the second joint comprise a threaded section and a quick release section, wherein the quick release section is provided with a connection hole, an end of the screw rod is provided with a protruding section, a shape and a size of the protruding section match with that of the connection hole, the protruding section is inserted into the connection hole and fixed with a bolt or pin, and the threaded section of the first joint is threaded to the spiral drill rod, and the threaded section of the second joint is threaded to the sampler.

7. The horizontal sampling soil drilling rig according to claim 1, wherein the spiral drill rod comprises a plurality of screw sections, the plurality of screw sections are fixedly spliced along an axial direction, and spiral vanes are arranged on the plurality of screw sections.

8. The horizontal sampling soil drilling rig according to claim 6, wherein a fixed connector is fixedly arranged on the first connection plate, and a shape and a size of the fixed connector match with that of the connection hole.

9. The horizontal sampling soil drilling rig according to claim 8, wherein the sampler comprises a sampling section and a plurality of connection sections, the sampling section and the plurality of connection sections are fixedly connected, and the plurality of connection sections are fixedly spliced along an axial direction, the sampling section is a cylindrical structure with an opening at one end, and an annular cutter is provided at the opening of the sampling section.

* * * * *